US011499543B2

(12) United States Patent
Roman

(10) Patent No.: US 11,499,543 B2
(45) Date of Patent: Nov. 15, 2022

(54) PNEUMATIC SURGE SUPPRESSOR

(71) Applicant: Graco Minnesota Inc., Minneapolis, MN (US)

(72) Inventor: Timothy S. Roman, Minnetonka, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 17/057,481

(22) PCT Filed: May 22, 2019

(86) PCT No.: PCT/US2019/033481
§ 371 (c)(1),
(2) Date: Nov. 20, 2020

(87) PCT Pub. No.: WO2019/226748
PCT Pub. Date: Nov. 28, 2019

(65) Prior Publication Data

US 2021/0310481 A1 Oct. 7, 2021

Related U.S. Application Data

(60) Provisional application No. 62/676,413, filed on May 25, 2018.

(51) Int. Cl.
*F15B 1/04* (2006.01)
*F04B 49/22* (2006.01)
(Continued)

(52) U.S. Cl.
CPC ..... *F04B 49/22* (2013.01); *F04B 11/0008* (2013.01); *F04B 45/0533* (2013.01);
(Continued)

(58) Field of Classification Search
CPC .. F04B 11/0008; F04B 11/0016; F04B 49/22; F04B 45/0533; F04B 45/0536;
(Continued)

(56) References Cited

U.S. PATENT DOCUMENTS 2,080,695 A * 5/1937 Cargile ..... F03C 1/035 417/225
2,320,886 A 6/1943 Francisco
(Continued)

FOREIGN PATENT DOCUMENTS

CN 1271815 A 11/2000
CN 1790210 A 6/2006
(Continued)

OTHER PUBLICATIONS

International Search Report and Written Opinion for PCT Application No. PCT/US2019/033481, dated Jul. 29, 2019, pp. 15.
(Continued)

*Primary Examiner* — Philip E Stimpert
*Assistant Examiner* — Dnyanesh G Kasture
(74) *Attorney, Agent, or Firm* — Kinney & Lange, P. A.

(57) ABSTRACT

A surge suppressor includes a boost mechanism configured to balance pressures between a working fluid and a process fluid. The boost mechanism includes a boost member that is acted on by a charge pressure of the working fluid. A shaft extends from the boost member to a pressure control member bounding the process fluid and acting on the process fluid. The boost member can have a larger effective area than the pressure control member to provide a pressure multiplication between the charge pressure and the process fluid pressure. In addition, pressure control valves are mounted to an air housing and actuated open by the boost mechanism. Actuating one of the pressure control valves open increases
(Continued)

the charge pressure. Actuating the other pressure control valve open decreases the charge pressure.

17 Claims, 4 Drawing Sheets

(51) Int. Cl.

| | |
|---|---|
| ***F04B 45/053*** | (2006.01) |
| ***F04B 49/08*** | (2006.01) |
| ***F04B 53/06*** | (2006.01) |
| ***F04B 53/12*** | (2006.01) |
| ***F04B 11/00*** | (2006.01) |

(52) U.S. Cl.
CPC ..... *F04B 45/0536* (2013.01); *F04B 49/08* (2013.01); *F04B 53/06* (2013.01); *F04B 53/129* (2013.01); *F04B 2205/03* (2013.01)

(58) Field of Classification Search
CPC ..... F04B 49/08; F04B 53/06; F04B 53/129; F04B 2205/03; F04B 2205/05; F04B 39/10; F04B 45/053; F04B 53/001; F15B 1/04–1/24
USPC ..... 417/540; 138/30, 31; 137/207
See application file for complete search history.

(56) References Cited

U.S. PATENT DOCUMENTS

| | | | | |
|---|---|---|---|---|
| 2,546,055 | A | 3/1951 | Ballard | |
| 2,992,630 | A | 7/1961 | Francis et al. | |
| 3,028,878 | A | 4/1962 | Natho | |
| 3,038,497 | A * | 6/1962 | Meek | F16K 11/056 137/596.2 |
| 3,122,169 | A | 2/1964 | Kendall | |
| 3,248,879 | A | 5/1966 | Natho | |
| 3,336,948 | A | 8/1967 | Lucien | |
| 3,474,830 | A | 10/1969 | Hertell | |
| 3,580,290 | A | 5/1971 | Sugimura et al. | |
| 3,741,692 | A * | 6/1973 | Rupp | F16L 55/052 417/540 |
| 4,068,684 | A | 1/1978 | Greer | |
| 4,195,668 | A | 4/1980 | Lewis | |
| 4,273,158 | A | 6/1981 | Chun | |
| 4,307,753 | A | 12/1981 | Dryer | |
| 4,312,382 | A | 1/1982 | Gebauer | |
| 4,544,328 | A | 10/1985 | Credle | |
| 4,556,087 | A | 12/1985 | Casilli | |
| 4,606,376 | A | 8/1986 | Bernard et al. | |
| 4,818,191 | A | 4/1989 | Schlake | |
| 5,036,879 | A | 8/1991 | Ponci | |
| 5,129,427 | A | 7/1992 | White et al. | |
| 5,171,134 | A | 12/1992 | Morgart et al. | |
| 5,337,791 | A | 8/1994 | Plager et al. | |
| 5,727,931 | A * | 3/1998 | Lash | B05B 5/1625 417/399 |
| 5,771,936 | A | 6/1998 | Sasaki et al. | |
| 6,056,013 | A | 5/2000 | Sasaki et al. | |
| 6,203,117 | B1 | 3/2001 | Starr et al. | |
| 6,325,105 | B1 | 12/2001 | Rogers | |
| 6,478,052 | B1 | 11/2002 | Conley et al. | |
| 7,661,442 | B2 | 2/2010 | O'Brien, II et al. | |
| 8,127,660 | B2 * | 3/2012 | Van Der Blom | F04B 39/0022 92/6 D |
| 8,313,313 | B2 * | 11/2012 | Juterbock | F04B 43/009 417/399 |
| 9,829,140 | B2 | 11/2017 | Harlann et al. | |
| 2017/0101986 | A1 * | 4/2017 | Horwath | F04B 11/0025 |
| 2019/0050004 | A1 * | 2/2019 | Rogers | F04B 43/02 |

FOREIGN PATENT DOCUMENTS

| | | | |
|---|---|---|---|
| CN | 2895829 | Y | 5/2007 |
| CN | 202144813 | U | 2/2012 |
| CN | 102954144 | A | 3/2013 |
| CN | 106414895 | A | 2/2017 |
| JP | 2000112152 | A | 4/2000 |
| PT | 792817 | E | 7/2001 |
| TW | 508408 | B | 11/2002 |

OTHER PUBLICATIONS

International Preliminary Report on Patentability for PCT Application No. PCT/US2019/033481, dated Dec. 10, 2020, pp. 9.
First Chinese Office Action for CN Application No. 201980033393.7, dated Dec. 28, 2021, pp. 8.

* cited by examiner

PNEUMATIC SURGE SUPPRESSOR

CROSS-REFERENCE TO RELATED APPLICATION

This application claims priority to U.S. Provisional Application No. 62/676,413 filed May 25, 2018, and entitled "PNEUMATIC SURGE SUPPRESSOR," the disclosure of which is hereby incorporated by reference in its entirety.

BACKGROUND

This disclosure relates generally to fluid displacement. More specifically, this disclosure relates to fluid pumps and vibration damping.

Surge suppressors are used in many industries to help dampen pressure variations and spikes in fluid handling systems. In paint circulation systems, the surge suppressors are used to dampen out the pressure pulsations created by the output of a reciprocating pump during change over between pump strokes.

Pneumatic surge suppressors typically incorporate a diaphragm disposed between a working fluid, such as compressed air, on one side of the diaphragm, and a process fluid, such as paint, on the other side of the diaphragm. The design inherently requires the air pressure to be about 75-100% of the fluid pressure on the other side of the diaphragm. Many paint systems operate at elevated pressures. As a result, the suppressor must be charged with air above the readily available shop air common in industrial settings, which is typically about 100 pounds per square inch (psi) (0.7 MPa). This requires the operator to charge the suppressors with special high pressure air or nitrogen tanks, inflating cost, time, and effort. Some systems incorporate an air multiplier, which is a pnuematicaly powered device that further compresses the air to increase the working fluid pressure provided to the pneumatic surge suppressor. The air multiplier can be plumbed into the inlet of the air section of the surge suppressor. Air multipliers can be costly and they can have long term reliability issues.

The pneumatic pressure in the surge suppressor is typically set and maintained manually. This requires constant monitoring and adjustment to take into account small leaks and changes in system fluid pressure. Some surge suppressors incorporate a spool valve to add and release air in an attempt to auto-adjust the pressure and to keep the diaphragm centered. The valves in the auto-adjust systems tend to chatter and leak and need to self-adjust on a regular basis.

The diaphragm provides a barrier between the process fluid and the working fluid. If the diaphragm ruptures, cross-contamination and leakage can occur. The internal component of the surge suppressor can become contaminated with paint, requiring the user to disassemble and clean the various components of the surge suppressor.

SUMMARY

According to an aspect of the disclosure, a surge suppressor includes a pressure control member; a boost member disposed within an air housing; and a shaft extending between and connecting the boost member and the pressure control member. The boost member at least partially defines a first chamber within the air housing, the first chamber configured to be pressurized with a working fluid to bias the pressure control member, via the boost member and the shaft, in a first direction.

According to another aspect of the disclosure, a fluid system includes a suppressor housing having a fluid inlet, a fluid outlet, and a process fluid chamber; an air housing mounted to the suppressor housing; a suppressor mechanism extending between the air housing and the suppressor housing; and a working fluid source connected to the air housing and configured to provide working fluid to a first chamber in the air housing to pressurize the first chamber. The suppressor mechanism includes a boost member disposed within the air housing and dividing the air housing into a first chamber and a second chamber; a pressure control member secured between the air housing and the suppressor housing, the pressure control member fluidly separating an air chamber and the process fluid chamber; and a shaft extending between and connecting the boost member and the pressure control member, the shaft extending through a wall disposed between the air chamber and the second chamber. The working fluid is configured to bias the pressure control member, via the boost member and the shaft, into the process fluid chamber.

According to yet another aspect of the disclosure, a method includes contacting a first pressure control valve with a first side of a boost member of a surge suppressor, thereby shifting the first pressure control valve to a first open state; flowing working fluid into an upper chamber of an air housing through the first pressure control valve with the first pressure control valve in the first open state, the working fluid increasing a charge pressure in the upper chamber; contacting a second pressure control valve with a second side of the boost member, thereby shifting the second pressure control valve to a second open state; flowing working fluid out of the upper chamber through the second pressure control valve with the second pressure control valve in the second open state, thereby decreasing the charge pressure in the upper chamber; wherein the boost member is connected to a pressure control member of the surge suppressor by a shaft extending between the boost member and the pressure control member; and wherein the pressure control member at least partially defines a fluid chamber through which process fluid flows, the pressure control member configured to dampen vibrations in the process fluid.

DETAILED DESCRIPTION

Figure 1:
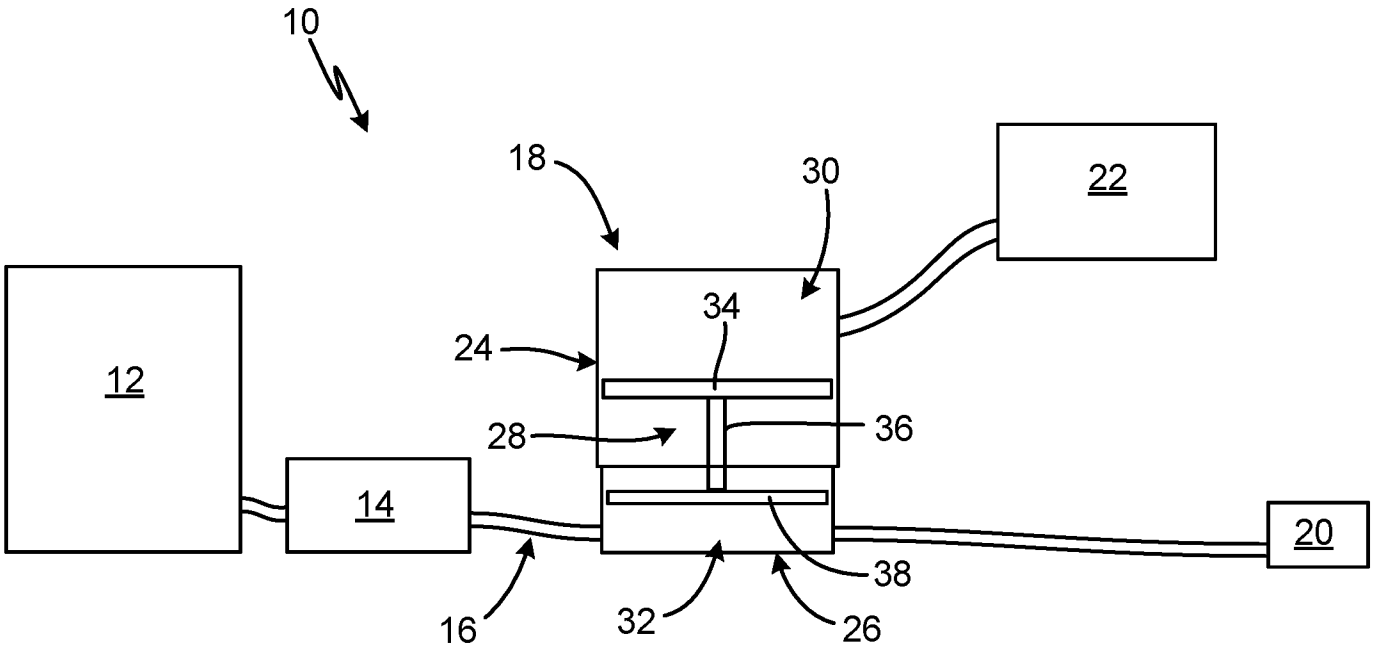
FIG. 1 is a schematic block diagram of a pumping system.

FIG. 1 is a schematic block diagram of fluid handling system 10. Fluid handling system 10 includes reservoir 12, pump 14, fluid line 16, surge suppressor 18, outlet 20, and working fluid source 22. Surge suppressor 18 includes air housing 24, process housing 26, suppressor mechanism 28, working fluid chamber 30, and process fluid chamber 32. Suppressor mechanism 28 includes boost member 34, shaft 36, and pressure control member 38.

Fluid handling system 10 is configured to provide process fluid at outlet 20 under pressure. In some examples, the process fluid is paint, such that fluid handling system 10 is a paint handling system. In some examples, the process fluid is lubricant, such that fluid handling system 10 is a lubricant handling system. In some examples, the process fluid is an automotive fluid, such as oil, coolant, washer fluid, and transmission fluid, among other options. As such, fluid handling system 10 can be an automotive fluid handling system. It is understood, however, that the fluid can be of any desired type.

Pump 14 pumps the process fluid from reservoir 12 through fluid line 16 to outlet 20. Pump 14 can be any desired type of pump. For example, pump 14 can be a positive displacement pump, a peristaltic pump, a rotary vane pump, a rotor-stator pump, or any other desired pump. Pump 14 can include a piston, a plunger, a diaphragm, or any other desired pumping mechanism. In some examples, pump 14 can generate high pressures of up to about 300 psi (about 2.1 MPa). It is understood, however, that surge suppressor 18 can be disposed in any fluid handling system 10 in which vibration damping is desired. For example, the process fluid pressure can exceed several thousand psi, in some cases up to 3,000 psi (about 21 MPa), in fluid spraying applications.

Outlet 20 is configured to output the process fluid. In some examples, outlet 20 is a sprayer, such fluid handling system 10 is a fluid spraying system. In one example, fluid handling system 10 is a paint spraying system. In some examples, outlet 20 is a dispenser. In one example, fluid handling system 10 is a lubricant dispensing system. In some examples, fluid handling system 10 is an automotive fluid dispensing system. It is understood that outlet 20 can of any type suitable for receiving fluid from reservoir 12 and outputting that fluid.

Surge suppressor 18 is disposed on fluid line 16. Air housing 24 is mounted on process housing 26. Fluid line 16 is connected to process housing 26 to provide fluid to process fluid chamber 32 disposed within process housing 26. Fluid line 16 extends downstream from process housing 26 to outlet 20. Suppressor mechanism 28 is disposed in surge suppressor 18. Boost member 34 is disposed in air housing 24 and at least partially defines working fluid chamber 30. Pressure control member 38 is disposed in process housing 26 and at least partially defines process fluid chamber 32. Shaft 36 extends between and connects boost member 34 and pressure control member 38. In some examples, boost member 34 can be a piston and pressure control member 38 can be a diaphragm. In some examples, boost member 34 can be a diaphragm and pressure control member 38 can be a piston. In other examples, both boost member 34 and pressure control member 38 can the same one of pistons and diaphragms.

Working fluid source 22 is connected to surge suppressor 18 and provides working fluid working fluid chamber 30 of surge suppressor 18. The working fluid charges surge suppressor 18 to a charge pressure. In some examples, working fluid source 22 is an air compressor, such that the working fluid is compressed air. For example, working fluid source 22 can be an air compressor in a machine or automotive shop. It is understood, however, that the working fluid can be of any type suitably configured for pressurizing working fluid chamber 30, such as compressed air or another pressurized gas. For example, the working fluid can be nitrogen. The compressed gas stores the energy needed to move boost member 34 downward.

Surge suppressor 18 is configured to damp pressure variations and pressure spikes in the process fluid being pumped to outlet 20. The charge pressure and the process fluid pressure create a force balance across suppressor mechanism 28 as the process fluid flows through process fluid chamber 32. In some examples, boost member 34 can have a larger effective area, which is the area acted on by the working fluid and driving displacement of the member, than pressure control member 38. The larger effective area of boost member 34 relative to the effective area of pressure control member 38 provides a boost effect, such that suppressor mechanism 28 exerts a greater force on the process fluid than the force of the working fluid acting on suppressor mechanism 28. The force generated by the working fluid pressure is thus multiplied through suppressor mechanism 28, thereby allowing the user to dampen vibrations between a high pressure process fluid flow and a lower pressure working fluid.

For example, the user can dampen vibrations in a process fluid having a pressure of about 300 psi with a working fluid source 22 capable of producing 100 psi of working fluid pressure. To effectively dampen such vibrations, the user can utilize suppressor mechanism 28 having a boost member 34 with an effective area three times as large as the effective area of pressure control member 38. Because boost member 34 has an effective area about three times as large as the effective area of pressure control member 38, the force exerted on the process fluid by pressure control member 38 will be three times as great as the force exerted on boost member 34 by the working fluid.

Suppressor mechanism 28 thereby provides force multiplication between the working fluid pressure acting on boost member 34 and the pressure exerted on the process fluid by pressure control member 38. The user can thereby utilize surge suppressor 18 with working fluid sources 22 capable of providing less pressure than the process fluid pressure output by pump 14. As such, surge suppressor 18 provides a low cost pressure multiplier and can be readily incorporated into existing fluid handling systems. In addition, surge suppressor 18 can be configured to provide any desired pressure ratio between the working fluid and the process fluid based on the effective areas of boost member 34 and pressure control member 38.

Figure 2A:
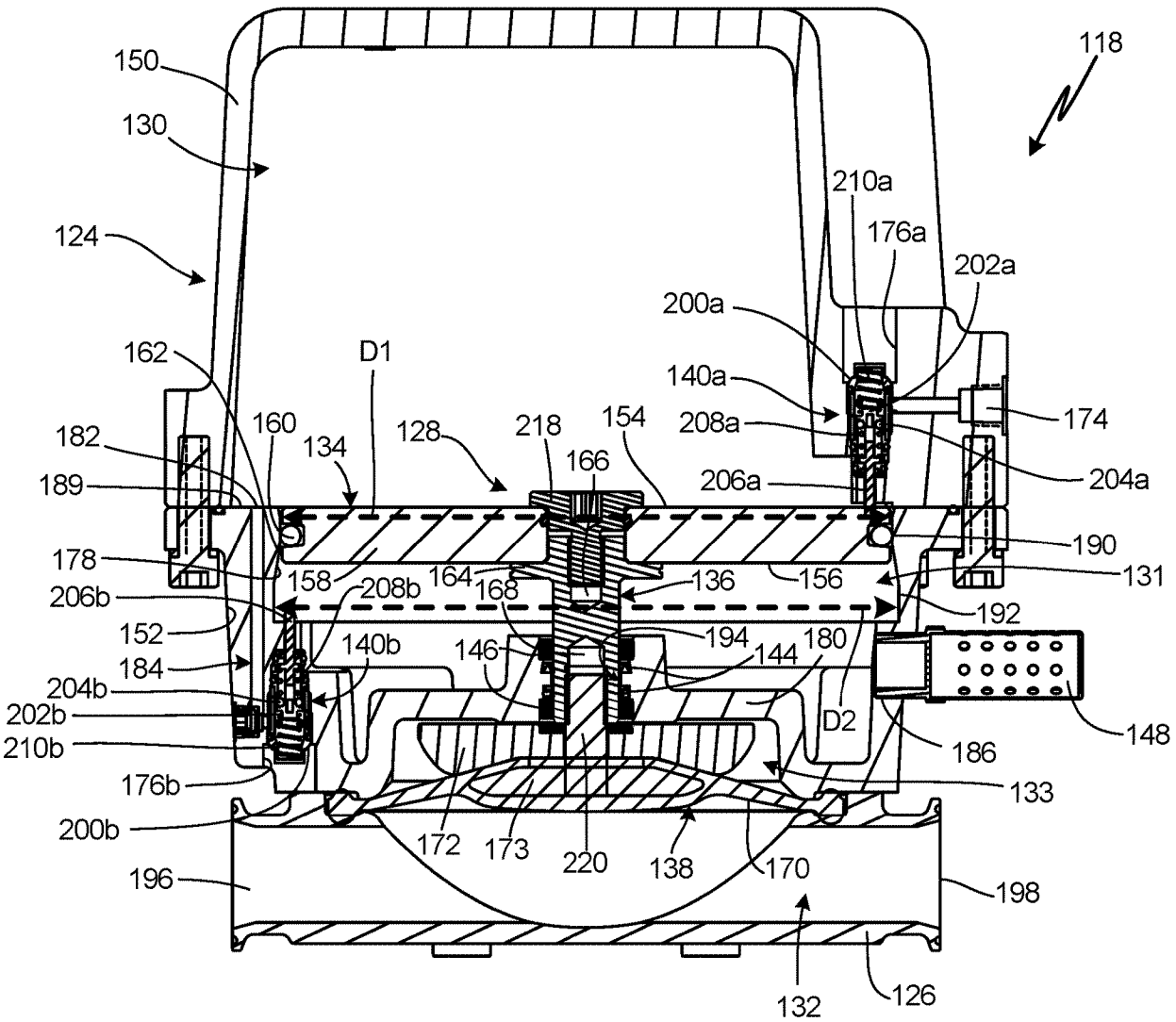
FIG. 2A is a first cross-sectional view of a surge suppressor.
Figure 2B:
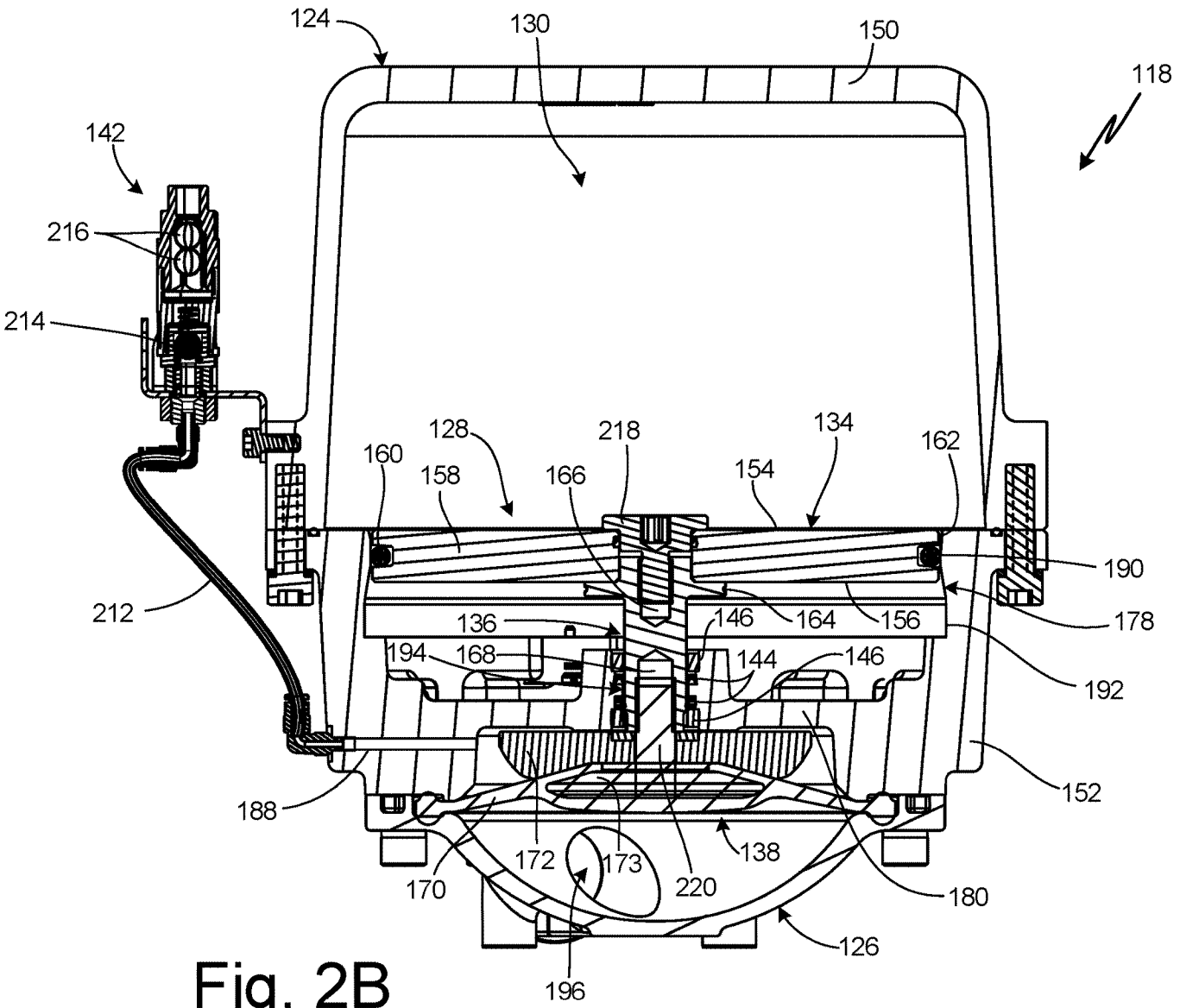
FIG. 2B is a second cross-sectional view of a surge suppressor.

FIG. 2A is a first cross-sectional view of surge suppressor 118. FIG. 2B is a second cross-sectional view of surge suppressor 118. FIGS. 2A and 2B will be discussed together. Surge suppressor 118 includes air housing 124; process housing 126; suppressor mechanism 128; pressure control valves 140*a*, 140*b* (FIG. 2A); check valve 142 (FIG. 2B); shaft seals 144; bearings 146; and exhaust muffler 148 (FIG. 2A). Suppressor mechanism 128 includes boost member 134, shaft 136, and pressure control member 138. Air housing 124 includes upper housing 150 and lower housing 152. Boost member 134 includes first side 154, second side 156, piston 158, and piston seal 160. Piston 158 includes circumferential edge 162. Shaft 136 includes flange 164, upper bore 166, and lower bore 168. Pressure control member 138 includes diaphragm 170, first plate 172, and second plate 173. Upper housing 150 includes working fluid inlet 174 (FIG. 2A) and valve bore 176*a* (FIG. 2A). Lower housing 152 includes valve bore 176*b* (FIG. 2A), chamber wall 178, lower wall 180, exhaust inlet 182 (FIG. 2A), exhaust path 184 (FIG. 2A), exhaust port 186 (FIG. 2A), check vent 188 (FIG. 2B), and horizontal face 189 (FIG. 2A). Chamber wall 178 includes upper end 190 and lower end 192. Lower wall 180 includes shaft bore 194. Process housing 126 includes fluid inlet 196 and fluid outlet 198 (FIG. 2A). Pressure control valves 140*a*, 140*b* include, respectively, valve housings 200*a*, 200*b*; valve members 202*a*, 202*b*; valve seats 204*a*, 204*b*; stems 206*a*, 206*b*; first springs 208*a*, 208*b*; and second springs 210*a*, 210*b*. Check valve 142 includes check line 212, check member 214, and floats 216.

Air housing 124 is mounted to process housing 126. Specifically, lower housing 152 of air housing 124 is mounted to process housing 126. A circumferential edge of diaphragm 170 is retained between lower housing 152 and process housing 126. Process fluid chamber 132 is defined by pressure control member 138 and process housing 126. During operation, process fluid enters surge suppressor 118 through fluid inlet 196, flows through process fluid chamber 132, and exits surge suppressor 118 through fluid outlet 198. Air chamber 133 is disposed between pressure control member 138 and lower housing 152.

Upper housing 150 is mounted to lower housing 152. While air housing 124 is shown as formed from separate housing parts, it is understood that air housing 124 can formed as a unitary part. Boost member 134 is disposed in air housing 124 and separates air housing 124 into upper chamber 130 and lower chamber 131. Upper chamber 130 is at least partially defined by first side 154 of boost member 134 and upper housing 150. Lower chamber 131 is at least partially defined by second side 156 of boost member 134 and lower housing 152. Upper chamber 130 and lower chamber 131 increase and decrease in volume during operation of surge suppressor 118. In the example shown, boost member 134 includes piston 158, which is configured to reciprocate within air housing 124. Piston seal 160 is disposed about circumferential edge 162 of piston 158. Piston seal 160 engages chamber wall 178 as piston reciprocates within air housing 124.

Chamber wall 178 partially defines lower chamber 131 within lower housing 152. Piston seal 160 engages with chamber wall 178 to form a seal between upper chamber 130 and lower chamber 131. Chamber wall 178 has a first diameter D1 at upper end 190 of chamber wall 178. Chamber wall 178 has a second diameter D2 at lower end 192 of chamber wall 178. In some examples, second diameter D2 is larger than first diameter D1. As such, chamber wall 178 is sloped between upper end 190 and lower end 192.

Piston seal 160 is disposed about circumferential edge 162 and within a groove extending around piston 158. Piston seal 160 is energized such that piston seal 160 expands and contracts within the groove to maintain engagement with chamber wall 178 as the diameter of chamber wall 178 changes during reciprocation of piston 158. The changing diameter of piston 158 effectively creates a variable effective area of piston 158 during reciprocation. As piston 158 moves downward, the effective area of piston 158 increases. As piston 158 moves upward, the effective area of piston 158 decreases. The changing effective area of boost member 134 alters the force multiplication across suppressor mechanism 128. The changing effective area assists in maintaining piston 158 in a floating position between pressure control valves 140*a*, 140*b* during operation. The changing effective area accounts for variations in air pressure in upper chamber 130 due to movement of piston 158. As piston 158 moves downward, the air pressure in upper chamber 130 drops due to the expansion of upper chamber 130. The increased effective area of piston 158 increases the ratio between the effective areas of piston 158 and diaphragm 170 to compensate for the pressure drop due to the expansion of upper chamber 130. As piston 158 moves upwards, the pressure in upper chamber 130 increases due to the reduction in the volume of upper chamber 130. The decreased effective area of piston 158 reduces the ratio between the effective areas of piston 158 and diaphragm 170 to compensate for the pressure increase due to the reduction of upper chamber 130. As such, piston 158 actuates pressure control valves 140*a*, 140*b* to respective open states less frequently, thereby preventing chattering and decreasing the volume of working fluid utilized during operation.

Valve bore 176*a* extends into upper housing 150. Pressure control valve 140*a* is disposed within valve bore 176*a*. In the example shown, valve housing 200*a* is secured within valve bore 176*a* to mount pressure control valve 140*a* to upper housing 150. Valve housing 200*a* can be secured within valve bore 176*a* in any suitable manner, such as by interfaced threading or press-fitting. Working fluid inlet 174 extends into upper housing 150 and is in fluid communication with valve bore 176*a*. Working fluid inlet 174 is configured to connect to a working fluid source, such as working fluid source 22 (FIG. 1), to provide working fluid to surge suppressor 118. For example, working fluid inlet 174 can receive a hose extending from an air compressor, in examples where the working fluid is compressed air. Pressure control valve 140*a* is a normally-closed valve that is configured to be opened by boost member 134. Pressure control valve 140*a* closes the fluid flow path between working fluid inlet 174 and upper chamber 130 when in a closed state, thereby preventing working fluid from entering upper chamber 130. Pressure control valve 140*a* opens the fluid flow path between working fluid inlet 174 and upper chamber 130 when in an open state, thereby allowing working fluid to flow into upper chamber 130. In the example shown, pressure control valve 140*a* is a poppet valve. It is understood, however, that pressure control valve 140*a* can be of any desired configuration for controlling the flow of working fluid across pressure control valve 140*a*.

Valve bore 176*b* extends into lower housing 152. Pressure control valve 140*b* is disposed within valve bore 176*b*. In the example shown, valve housing 200*b* is secured within valve bore 176*b* to mount pressure control valve 140*b* to lower housing 152. Valve housing 200*b* can be secured within valve bore 176*b* in any suitable manner, such as by interfaced threading or press-fitting. Pressure control valve 140*b* is a normally-closed valve that is configured to be opened by boost member 134. Pressure control valve 140*b* closes the fluid flow path between upper chamber 130 and lower chamber 131 when in a closed state, thereby preventing working fluid from venting from upper chamber 130 to lower chamber 131. Pressure control valve 140*b* opens the fluid flow path between upper chamber 130 and lower chamber 131 when in an open state, thereby allowing working fluid to vent from upper chamber 130 to lower chamber 131. In the example shown, pressure control valve 140*b* is a poppet valve. It is understood, however, that pressure control valve 140*b* can be of any desired configuration for controlling the flow of working fluid across pressure control valve 140*b*.

Exhaust inlet 182 extends through horizontal face 189 of lower housing 152. Exhaust path 184 extends through lower housing 152 between exhaust inlet 182 and valve bore 176*b*. Exhaust path 184 provides a flowpath from upper chamber 130 to pressure control valve 140*b*, to facilitate venting of working fluid from upper chamber 130 to lower chamber 131. Exhaust port 186 extends through lower housing 152 between an exterior of lower housing 152 and lower chamber 131. Exhaust muffler 148 is mounted to exhaust port 186. Working fluid vented to lower chamber 131 through pressure control valve 140*b* can be exhausted to the atmosphere through exhaust port 186 and exhaust muffler 148. While the working fluid is described as exhausted to atmosphere, it is understood that the working fluid can be exhausted to any location suitable for receiving the working fluid. For example, if the working fluid is hydraulic fluid or another liquid, then the working fluid can be exhausted to a reservoir suitable for receiving the working fluid.

For each pressure control valve 140*a*, 140*b*, valve housings 200*a*, 200*b* are respectively mounted in valve bores 176*a*, 176*b*. Valve members 202*a*, 202*b* are disposed within valve housings 200*a*, 200*b*. Valve members 202*a*, 202*b* engage valve seats 204*a*, 204*b* to prevent flow through pressure control valves 140*a*, 140*b* and disengage from valve seats 204*a*, 204*b* to allow flow through pressure control valves 140*a*, 140*b*. Stems 206*a*, 206*b* extend from valve members 202*a*, 202*b* into upper chamber 130 and lower chamber 131, respectively. First springs 208*a*, 208*b* are respectively disposed between stems 206*a*, 206*b* and valve members 202*a*, 202*b*. Second springs 210*a*, 210*b* are respectively disposed in valve housings 200*a*, 200*b* and are configured to bias valve members 202*a*, 202*b* towards engagement with valve seats 204*a*, 204*b*.

Pressure control member 138 bounds and at least partially defines process fluid chamber 132. Pressure control member 138 is configured to rise and fall with the process fluid flowing through process fluid chamber 132. Suppressor mechanism 128 exerts a compressive force on the process fluid flowing through process fluid chamber 132 via pressure control member 138. The compressive force is generated by the working fluid pushing downward on suppressor mechanism 128 via boost member 134. The force exerted by suppressor mechanism 128 counteracts pressure spikes in the process fluid, thereby damping vibrations in the process fluid.

Pressure control member 138 also bounds and at least partially defines air chamber 133 on a side of pressure control member 138 opposite process fluid chamber 132. Pressure control member 138 fluidly isolates air chamber 133 and process fluid chamber 132.

Shaft 136 extends between and connects boost member 134 and pressure control member 138. Flange nut 218 extends through piston 158. A portion of flange nut 218 is secured within upper bore 166 of shaft 136. For example, flange nut 218 can include exterior threading that interfaces with interior threading in upper bore 166. Piston 158 is secured between flange nut 218 and flange 164 of shaft 136. Shaft 136 extends from piston 158 and through shaft bore 194 in lower wall 180 of lower housing 152. Shaft seals 144 are disposed in shaft bore 194 and extend around shaft 136. Shaft seals 144 create fluid seals between shaft 136 and lower housing 152 to prevent fluid leakage between lower chamber 131 and air chamber 133. Bearings 146 are disposed in shaft bore 194 and support shaft 136 as shaft 136 reciprocates. For example, bearings 146 can be linear bearings.

In the example shown, pressure control member 138 is a diaphragm assembly. First plate 172 is disposed on a back side of diaphragm 170 and can distribute force from shaft 136 across a large area of diaphragm. Second plate 173 is overmolded into diaphragm 170. Set screw 220 extends into lower bore 168 of shaft 136 to secure pressure control member 138 to shaft 136. Set screw 220 can connect to each of pressure control member 138 and shaft 136 in any desired manner, such as by interfaced threading, press-fitting, or a combination thereof. In some examples, set screw 220 is integral with diaphragm 170. For example, set screw 220 can be overmolded into diaphragm 170.

Check vent 188 extends through lower housing 152 and is fluidly connected to air chamber 133. Check line 212 is attached to and extends from lower housing 152. Check valve 142 is attached to check line 212. Check line 212 provides a flowpath between air chamber 133 and check valve 142. Check member 214 of check valve 142 is normally closed, but pressure in check line 212 can cause check member 214 to shift to an open position to allow flow out of air chamber 133. For example, check member 214 can include a ball biased towards a closed state by a spring. Floats 216 are disposed above check member 214. Floats 216, in the example show, are hollow balls configured to float on liquid.

Check valve 142 allows air to vent from air chamber 133 but prevents fluid leakage. During operation, air can vent from air chamber 133 through check vent 188, check line 212, and check member 214. The pressure of the air can cause check member 214 to open, thereby relieving any pressure in air chamber 133. The air passes by floats 216 and exits check valve 142. If a leak occurs between process fluid chamber 132 and air chamber 133, the leaking fluid can flow through check vent 188 and check line 212 to check member 214. The pressure of the leaking fluid can cause check member 214 to open. However, floats 216 rise on the fluid within the housing of check valve 142 and engage a seat disposed above floats 216 in check valve 142. The floats 216 thereby seal a fluid path out of check valve 142 to prevent fluid leakage. Check valve 142 thereby allows air venting while preventing fluid leakage. In the case of any fluid leakage into air chamber 133, shaft seals 144 prevent the fluid from leaking around shaft 136 and into lower chamber 131. As such, shaft seals 144 prevent process fluid contamination of passages that the working fluid flows within.

Surge suppressor 118 can provide a force multiplication between the force generated by the working fluid pressure and the force exerted on the process fluid. As such, surge suppressor 118 can effectively dampen vibrations in higher pressure process fluids where working fluid of a sufficiently high pressure is unavailable. Boost member 134 can have a first effective area and pressure control member 138 can have a second effective area. The ratio between the effective areas provides the force multiplication. For example, where the first effective area is larger than the second effective area, suppressor mechanism 128 provides a force boost between boost member 134 and pressure control member 138. The larger effective area of boost member 134 means that a lower charge pressure can be utilized while maintaining a force balance with the process fluid. A lower working fluid pressure can thus be utilized to provide vibration damping.

Automotive shops may be able to provide up to 100 psi of working fluid pressure. An appropriate ratio between the first effective area and the second effective area can be selected based on the desired process fluid pressure for the application. For example, the desired process fluid pressure can be 300 psi. To effectively dampen vibrations in the process fluid, surge suppressor 118 needs to exert about 300 psi on the process fluid via pressure control member 138. Utilizing a suppressor mechanism 128 having a ratio of 3:1 between the first effective area and the second effective area allows the user to effectively dampen vibrations in a 300 psi process fluid with a 100 psi working fluid. In some systems, the user can change air housing 124 and piston 158 to increase or decrease the ratio between the effective areas to suit the particular fluid handling need.

During operation, process fluid flows through process fluid chamber 132 from fluid inlet 196 to fluid outlet 198. Suppressor mechanism 128 is configured to dampen any vibrations in the process fluid. The working fluid in upper chamber 130 acts on first side 154 of boost member 134 to exert a downward force on suppressor mechanism 128. The force is transferred to pressure control member 138 via shaft 136. The force exerted on the process fluid by pressure control member 138 dampens any pressure spikes and vibrations in the process fluid. To provide effective damping, the force exerted by pressure control member 138 on the process fluid is maintained at about equal to the upward force exerted on suppressor mechanism 128 by the process fluid pressure. With the forces on each side of suppressor mechanism 128 (e.g., the downward force exerted by the working fluid and the upward force exerted by the process fluid) balanced, piston 158 floats within air housing 124 midway between pressure control valves 140*a*, 140*b*.

Variations in process fluid pressure and working fluid pressure can occur during operation. Surge suppressor 118 is configured to automatically accommodate and adjust to pressure differentials by increasing or decreasing the charge pressure of the working fluid in upper chamber 130.

Working fluid is provided to upper chamber 130 through working fluid inlet 174 and pressure control valve 140*a*. The working fluid charges upper chamber 130 to a charge pressure. The charge pressure acts on first side 154 of boost member 134 to bias suppressor mechanism 128 downward. The process fluid pressure acts on pressure control member 138 to bias suppressor mechanism 128 upwards. With the pressure forces balanced, piston 158 floats between pressure control valves 140*a*, 140*b*, while pressure control valves 140*a*, 140*b* remain in respective normally-closed states.

Piston 158 rises within air housing 124 as the upward force on suppressor mechanism 128 exceeds the downward force on suppressor mechanism 128. Piston 158 continues to rise within air housing 124 until first side 154 encounters and drives pressure control valve 140*a* to an open state.

First side 154 initially contacts stem 206*a*, driving stem 206*a* upwards. Stem 206*a* moves upwards and compresses first spring 208*a* between stem 206*a* and valve member 202*a*. First spring 208*a* pushes upwards on valve member 202*a*, exerting a first force on a downstream side of valve member 202*a*. Second spring 210*a* and the working fluid pressure upstream of pressure control valve 140*a*, in working fluid inlet 174, push downward on valve member 202*a*, thereby exerting a second force on an upstream side of valve member 202*a*. As such, the first force is initially the mechanical force of first spring 208*b* and the fluid pressure in upper chamber 130. The second force is initially the mechanical force of second spring 210*b* and the fluid force of the working fluid pressure in working fluid inlet 174. In some examples, first spring 208*a* and second spring 210*a* have substantially similar spring forces. In some examples, first spring 208*a* has a larger spring force than second spring 210*a*, such that first spring 208*a* exerts a greater force on stem 206*a* than second spring 210*a*.

Valve member 202*a* does not immediately shift into the open state because the second force is initially greater than the first force due to the working fluid pressure upstream of pressure control valve 140*a*. As piston 158 continues to rise, the first force eventually reaches and exceeds the second force. Valve member 202*a* then shifts off of and disengages from valve seat 204*a*. Valve member 202*a* disengaging from valve seat 204*a* opens a flowpath through pressure control valve 140*a*. The working fluid flows through that flowpath and the fluid pressure equalizes across valve member 202*a*. The pressure equalization causes the second force to suddenly drop from the combined fluid pressure of the working fluid and the mechanical force of second spring 210*a* to just the mechanical force of second spring 210*a*. With the working fluid pressure equalized on both sides of valve member 202*a*, the first force is the mechanical upward force generated by first spring 208*a* and the second force is the mechanical downward force generated by second spring 210. First spring 208*a* is compressed as stem 206*a* shifts, but second spring 210*a* is not initially compressed as valve member 202*a* is maintained in the closed state. When valve member 202*a* disengages from seat 204*a*, the sudden drop in the second force creates a force differential on valve member 202*a* between the force exerted by first spring 208*a* and the force exerted by second spring 210*a*. The forces balance by first spring 208*a* expanding and second spring 210*a* contracting, which causes valve member 202*a* to pop open. Valve member 202*a* popping open opens a wide flow path through pressure control valve 140*a*. Valve member 202*a* popping fully open prevents valve chatter that can occur when a valve is quickly cycled between open and closed states.

As such, when stem 206*a* is pressed, stem 206*a* moves until the spring force and the pressure force on the downstream side of valve member 202*a* equal the spring force of second spring 210*b* and the pressure force on the upstream side of valve member 202*a*. When this happens, pressure control valve 140*a* starts to crack open and due to the flow, the pressure above valve member 202*a* reduces. This upsets the force balance and valve member 202*a* pops open to the full extent first spring 208*a*. This creates a hysteresis effect and keeps pressure control valve 140*a* from just slightly opening and causing a slow leak.

The working fluid flows through pressure control valve 140*a* and into working fluid chamber, increasing the charge pressure in upper chamber 130. The charge pressure in upper chamber 130 continues to rise until the working fluid pressure causes piston 158 to shift downward, removing the force maintaining valve member 202*a* in the open state. Valve member 202*a* follows the travel of piston 158*a*. Piston 158 disengages from stem 206 and valve member 202*a* reengages with valve seat 204*a*, thereby closing the flow path through pressure control valve 140*a*. Pressure control valve 140*a* fluidly isolates working fluid inlet 174 and upper chamber 130 when in the closed state, thereby preventing the working fluid from flowing into upper chamber 130.

The working fluid pushes piston 158 downward within air housing 124 to balance forces across suppressor mechanism 128 between the working fluid pressure and the process fluid pressure. As the process fluid pressure drops, piston 158 falls within air housing 124. The force differential continues to fall until boost member 134 encounters and drives pressure control valve 140*b* to an open state.

Second side 156 initially contacts stem 206*b* and drives stem 206*b* downwards. Stem 206*b* moves downward and compresses first spring 208*b* between stem 206*b* and valve member 202*b*. First spring 208*b* pushes downward on valve member 202*b*, exerting a first force on a downstream side of valve member 202*b*. Second spring 210*b* and the working fluid pressure upstream of pressure control valve 140*b*, in upper chamber 130, push upward on valve member 202*b*, thereby exerting a second force on an upstream side of valve member 202*b*. As such, the first force is initially the mechanical force of first spring 208*b* and the fluid pressure in lower chamber 131. In some examples, the fluid pressure in lower chamber 131 can be atmospheric pressure. The second force is initially the mechanical force of second spring 210*b* and the fluid force of the working fluid pressure in upper chamber 130. In some examples, first spring 208*b* and second spring 210*b* have substantially similar spring forces. In some examples, first spring 208*b* has a larger spring force than second spring 210*b*, such that first spring 208*b* exerts a greater force on stem 206*b* than second spring 210*b*.

Valve member 202*b* does not immediately shift into the open state because the second force is initially greater than the first force. As piston 158 continues to rise, the first force continues to rise and eventually reaches and exceeds the second force. Valve member 202*b* then shifts off of and disengages from valve seat 204*b*. Valve member 202*b* disengaging from valve seat 204*b* opens a flowpath through pressure control valve 140*b*. The working fluid flows from upper chamber 130, into exhaust path 184 through exhaust inlet 182, and to valve member 202*b*. The working fluid flows through the flowpath between valve member 202*b* and valve seat 204*b* and into lower chamber 131. From lower chamber 131, the working fluid can vent to atmosphere through exhaust port 186 and exhaust muffler 148. While lower chamber 131 is described as venting to atmosphere, it is understood that lower chamber 131 can vent to any environment suitable for receiving the exhausted working fluid.

The fluid pressure equalizes across pressure control valve 140*b* when valve member 202*b* disengages from valve seat 204*b*. The pressure equalization causes the second force to suddenly drop from the combined fluid pressure of the working fluid and the mechanical force of second spring 210*b* to just the mechanical force of second spring 210*b*. With the working fluid pressure equalized on both sides of valve member 202*b*, the first force is the mechanical upward force generated by first spring 208*b*. First spring 208*b* is compressed as stem 206*b* shifts, but second spring 210*b* is not initially compressed as valve member 202*b* is maintained in the closed state. When valve member 202*b* disengages from seat 204*b*, the sudden drop in the second force creates a force differential on valve member 202*b* between the force exerted by first spring 208*b* and the force exerted by second spring 210*b*. The forces balance by first spring 208*b* expanding and second spring 210*b* contracting, which causes valve member 202*b* to pop open. Valve member 202*b* popping open opens a wide flow path through pressure control valve 140*b*. Valve member 202*b* popping fully open prevents valve chatter that can occur when a valve is quickly cycled between open and closed states.

With pressure control valve 140*b* in the open state, the working fluid can flow from upper chamber 130 to lower chamber 131 through exhaust path 184 and pressure control valve 140*b*. The working fluid venting to lower chamber 131 is exhausted to atmosphere via exhaust port 186 and exhaust muffler 148. The charge pressure in upper chamber 130 drops as the working fluid vents from upper chamber 130. The charge pressure continues to drop until the force differential across suppressor mechanism 128 causes suppressor mechanism 128 to rise, thereby causing piston 158 to rise within air housing 124. Piston 158 continues to rise within air housing 124 and valve member 202*b* reengages with valve seat 204*b*. Valve member 202*b* engaging valve seat 204*b* closes the flow path through pressure control valve 140*b*, thereby stopping the working fluid venting.

The charge pressure within upper chamber 130 is automatically controlled by surge suppressor 118. Boost member 134 causes pressure control valve 140*a* to open and allow working fluid into upper chamber 130 to increase the charge pressure. Boost member 134 moves away from and causes pressure control valve 140*a* to close when the charge pressure reaches a desired level such that the forces are balanced across suppressor mechanism 128. Boost member 134 causes pressure control valve 140*b* to open and allow working fluid to vent from upper chamber 130 to decrease the charge pressure. Boost member 134 moves away from and causes pressure control valve 140*b* to close when the charge pressure reaches a desired level such that the forces are balanced across suppressor mechanism 128. Surge suppressor 118 thereby automatically increases and/or decreases the charge pressure in response to a changing force differential between the forces generated by the process fluid pressure and the working fluid pressure. The user can set the working fluid pressure upstream pressure control valve 140*a* at any desired pressure level and surge suppressor 118 will automatically regulate the flow into upper chamber 130, thereby preventing over- and/or under-pressurization.

Surge suppressor 118 provides significant advantages. Boost member 134 can oscillate between pressure control valves 140*a*, 140*b* to automatically input working fluid to upper chamber 130 and vent working fluid from upper chamber 130, thereby adjusting the charge pressure in upper chamber 130. Pressure control valves 140*a*, 140*b* incorporate hysteresis to prevent undesirable operation, for example excessive filling and dumping of air pressure from cycle to cycle (chatter). Pressure control valves 140*a*, 140*b* incorporate springs to create hysteresis, which delays pressure control valves 140*a*, 140*b* shifting to the open state. The hysteresis prevents valve chattering and ensures that pressure control valves 140*a*, 140*b* open in response to a need, such as a change in fluid pressure or to compensate for slow long terms leaks, not as soon as pressure control valve 140*a*, 140*b* are contacted.

Surge suppressor 118 also provides force multiplication. As such, surge suppressor 118 is capable of suppressing vibrations in the process fluid utilizing a working fluid having a pressure lower than the process fluid pressure. The force multiplication allows surge suppressor 118 to provide effective pressure damping for higher pressure pumping operations in systems where working fluid of a sufficiently high pressure is unavailable. The force multiplication provided by suppressor mechanism 128 eliminates charge multiplier and other such devices separate from the surge suppressor that increase the pressure of the working fluid beyond the maximum level generated by the working fluid source. As such, suppressor mechanism 128 provides a low-cost, compact mechanism for effectively damping vibrations.

Furthermore, surge suppressor 118 automatically balances at start up. If working fluid begins to flow before the process fluid, pressure control valve 140*a* will prevent the working fluid from entering upper chamber 130 until the process fluid begins to flow. When the process fluid begins to flow, the process fluid pressure will cause suppressor mechanism 128 to rise such that boost member 134 actuates pressure control valve 140*a* to an open state. The working fluid flows into and charges upper chamber 130 until a force balance is achieved. The force balance causes piston 158 to move to an optimized position within air housing 124 between pressure control valves 140*a*, 140*b*. The user does not need to monitor and adjust the charge pressure during operation. As such, pressure damping is more efficient and requires less direct user interaction. In addition, surge suppressor 118 automatically vent the working fluid from upper chamber 130 at shut down, thereby relieving the charge pressure in upper chamber 130 and prevents over-pressurization. At shut down, the process fluid stops flowing and the charge pressure drives suppressor mechanism 128 downward. Boost member 134 opens pressure control valve 140*b*, thereby opening exhaust path 184 between upper chamber 130 and lower chamber 131. The working fluid vents from upper chamber 130, thereby de-pressurizing upper chamber 130.

Figure 3:
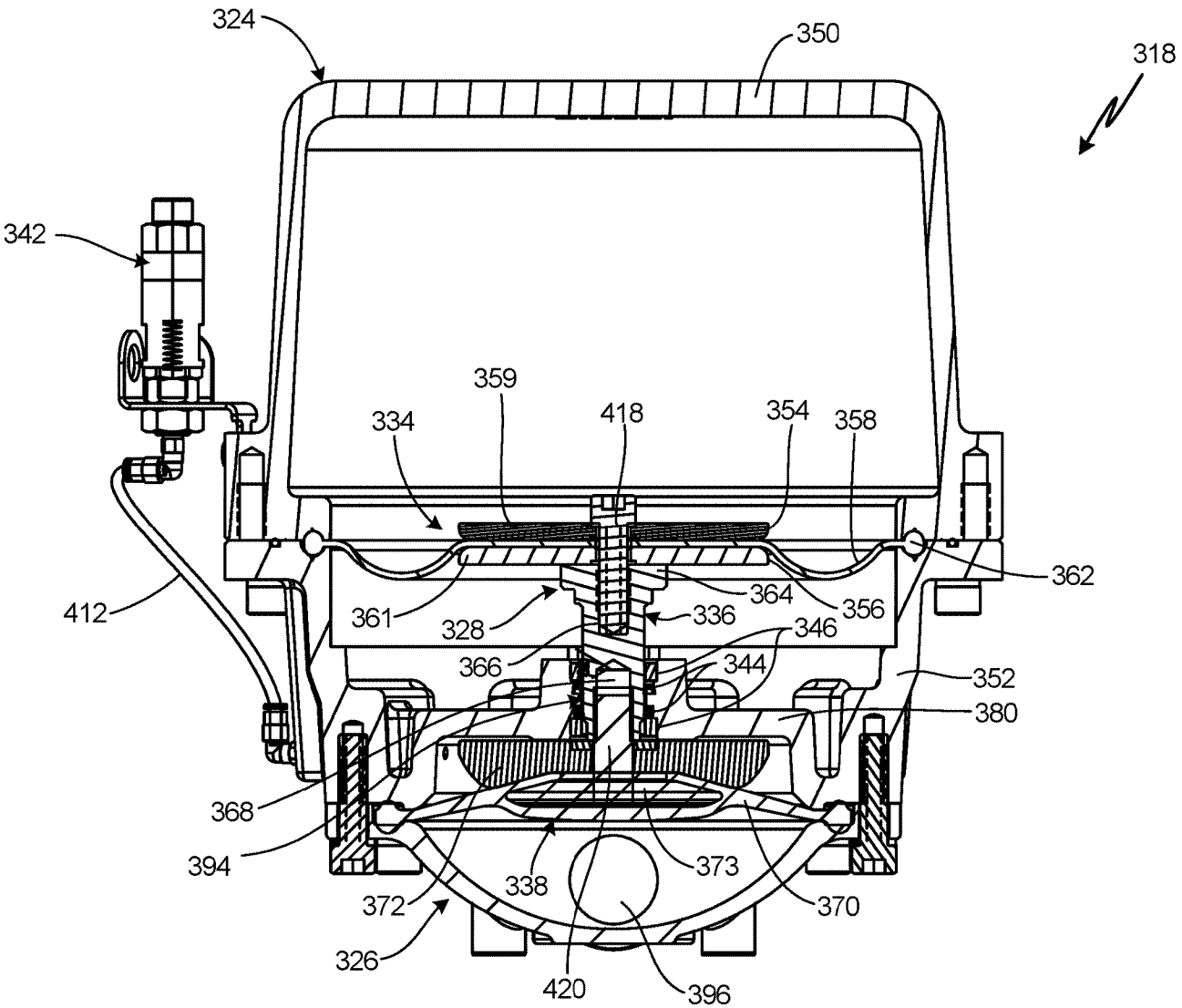
FIG. 3 is a cross-sectional view of a surge suppressor.

FIG. 3 is a cross-sectional view of surge suppressor 318. Air housing 324, process housing 326, suppressor mechanism 328, check valve 342, shaft seals 344, and bearings 346 of surge suppressor 318 are shown. Suppressor mechanism 328 includes boost member 334, shaft 336, and pressure control member 338. Air housing 324 includes upper housing 350 and lower housing 352. Boost member 334 includes first side 354, second side 356, diaphragm 358, upper plate 359, lower plate 361, and screw 418. Shaft 336 includes flange 364, upper bore 366, and lower bore 368. Pressure control member 338 includes diaphragm 370, first plate 372, second plate 373, and set screw 420. Lower wall 380 of lower housing 352 is shown, and lower wall 380 includes shaft bore 394. Fluid inlet 396 of process housing 326 is shown. Check line 412 extends to check valve 342.

Surge suppressor 318 is substantially similar to surge suppressor 318 (FIGS. 2A and 2B) and surge suppressor 18 (FIG. 1). Surge suppressor 318 and is configured to operate according to the techniques described herein.

Air housing 324 is mounted on process housing 326. Specifically, lower housing 352 is mounted on process housing 326. Upper housing 350 is mounted on lower housing 352 to form air housing 324. Boost member 334 is secured between upper housing 350 and lower housing 352. Boost member 334 divides the air housing 324 into upper chamber 330 and lower chamber 331. Upper chamber 330 is defined by first side 354 of boost member 334 and upper housing 350. Lower chamber 331 is defined by second side 356 of boost member 334 and lower housing 352. The respective volumes of upper chamber 330 and lower chamber 331 increase and decrease as the force differential across suppressor mechanism 328 fluctuates during operation.

Circumferential edge 362 of diaphragm 358 is captured between upper housing 350 and lower housing 352. Diaphragm 358 is configured to flex during operation as pressure control member 338 shifts during operation. Diaphragm 358 is clamped between upper plate 359 and lower plate 361. Upper plate 359 is disposed on first side 354 of boost member 334. Lower plate 361 is disposed on second side of boost member 334. In some examples, upper plate 359 and lower plate 361 are configured to contact and actuate valves, such as pressure control valves 140*a*, 140*b* (FIGS. 2A and 2B), to control the charge pressure in upper chamber 330. It is understood, however, that boost member 334 can be configured to actuate the pressure control valves in any suitable manner.

Screw 418 extends through upper plate 359, diaphragm 358, and lower plate 361 and into upper bore 366 of shaft 336. Screw 418 secures boost member 334 to shaft 336. Shaft 336 extends through shaft bore 394 in lower housing 352 and is connected to pressure control member 338. Shaft seals 344 extend around shaft 336 and provides a seal in shaft bore 394 between shaft 336 and lower housing 352. Shaft seals 344 prevent fluid leakage between lower chamber 331 and air chamber 333. Bearings 346*a*, 346*b* are disposed in wall bore # and support shaft 336 as shaft 336 reciprocates.

Pressure control member 338 bounds and at least partially defines process fluid chamber 332 on a first side of pressure control member 338. Pressure control member 338 is configured to rise and fall with the process fluid flowing through process fluid chamber 332 to dampen any downstream vibrations. Pressure control member 338 also bounds and at least partially defines air chamber 333 on a second side of pressure control member 338. Pressure control member 338 fluidly isolates air chamber 333 and process fluid chamber 332.

During operation, the process fluid flows through process fluid chamber 332. The process fluid pressure exerts a first force on pressure control member 338 of suppressor mechanism 328 that pushes suppressor mechanism 328 upwards. Working fluid is provided to upper chamber 330 to charge upper chamber 330 to a charge pressure. The charge pressure exerts a second force on boost member 334 of suppressor mechanism 328 that pushes suppressor mechanism 328 downwards. Suppressor mechanism 328 is configured to balance the forces acting on suppressor mechanism 328 to dampen pressure spikes and vibrations in the process fluid flowing through process fluid chamber 332.

Boost member 334 rises within upper chamber 330 as the force generated by the process fluid pressure overcomes the force generated by the working fluid pressure. Boost member 334 rises and contacts a first pressure control valve, such as pressure control valve 140*a*, and actuates the first pressure control valve to an open state. With the first pressure control valve in the open state, working fluid flows into upper chamber 330, thereby increasing the fluid pressure within upper chamber 330. The charge pressure continues to increase until the force differential causes boost member 334 to shift downward, thereby removing force from the first pressure control valve and allowing the first pressure control valve to return to a closed state.

Boost member 334 falls within upper chamber 330 as the force generated by the working fluid pressure overcomes the force generated by the process fluid pressure. Boost member 334 falls and contacts a second pressure control valve, such as pressure control valve 140*b*, and actuates the second pressure control valve to an open state. With the second pressure control valve in the open state, working fluid flows out of upper chamber 330 to lower chamber 331 through an exhaust path, such as exhaust path 184 (FIG. 2A). The working fluid can be exhausted from lower chamber 331 in any desired manner. For example, the working fluid can be exhausted to atmosphere in examples where the working fluid is compressed air.

The charge pressure in upper chamber 330 drops as the working fluid vents from upper chamber 330 to lower chamber 331. The charge pressure continues to decrease until the force differential across suppressor mechanism 328 causes boost member 334 to shift upward, thereby removing force from the second pressure control valve and allowing the second pressure control valve to return to a closed state.

Surge suppressor 318 provides significant advantages. Suppressor mechanism 328 has different effective areas acted on by the working fluid pressure and the process fluid pressure. The different effective areas provide a force multiplication across suppressor mechanism 328. As such, suppressor mechanism 328 can damp vibrations in higher pressure process fluids utilizing lower pressure working fluids. For example, a shop may be able to provide up to 100 psi of working fluid pressure. An appropriate ratio between the first effective area and the second effective area can be selected based on the application. In examples where the desired process fluid pressure is 300 psi, the first effective area can be three times as large as the second effective area.

The circumferential edge of diaphragm 370 of boost member 334 is secured between upper housing 350 and lower housing 352, such that a static seal separates upper chamber 330 and lower chamber 331. As such, some moving parts can be removed from surge suppressor 318. Surge suppressor 318 also automatically balances forces between the charge pressure and the process fluid pressure. As such, user oversight and involvement is reduces, increasing work efficiency and freeing the user to accomplish other tasks.

Boost member 334 can oscillate between the first and second pressure control valves to automatically input working fluid to upper chamber 330 and vent working fluid from upper chamber 330, thereby adjusting the charge pressure in upper chamber 330. The pressure control valves can incorporate hysteresis to prevent undesirable operation, for example excessive filling and dumping of air pressure from cycle to cycle (chatter).

Surge suppressor 318 also automatically balances within air housing 324 at start up. Surge suppressor 318 also automatically vents pressure from upper chamber 330 at shut down and prevents over-pressurization. The user does not need to monitor and adjust the charge pressure during operation. As such, pressure damping is more efficient and requires less direct user interaction.

Although the present invention has been described with reference to preferred embodiments, workers skilled in the art will recognize that changes may be made in form and detail without departing from the spirit and scope of the invention.

The invention claimed is:

1. A surge suppressor comprising:

a pressure control member;

a boost member disposed within an air housing and connected to the pressure control member to move with the pressure control member;

a first pressure control valve mounted to the air housing and disposed on a first side of the boost member;

a second pressure control valve mounted to the air housing and disposed on a second side of the boost member;

wherein the boost member at least partially defines a first chamber within the air housing and a second chamber within the air housing, the first chamber configured to be pressurized with a working fluid to bias the pressure control member, via the boost member, in a first direction and into a process fluid chamber, the process fluid chamber on an opposite side of the pressure control member from the boost member;

wherein the first chamber is disposed on the first side of the boost member and the second chamber is disposed on the second side of the boost member opposite the first side and the boost member interfaces with the air housing to fluidly isolate the first chamber and the second chamber;

wherein the first pressure control valve is configured to be actuated by the boost member between:

an open state, in which a first fluid path through the first pressure control valve is open, the first fluid path fluidly connecting the first chamber and a working fluid source, and the first fluid path is disposed downstream of the working fluid source and upstream of the first chamber, and a closed state, in which the first fluid path of the first pressure control valve is closed to fluidly isolate the first chamber and the working fluid source; and wherein the second pressure control valve is configured to be actuated by the boost member between:

an open state, in which a second fluid path through the second pressure control valve is open to vent working fluid from the first chamber through the second pressure control valve, the second fluid path is disposed downstream of the first chamber, and a closed state, in which the second fluid path of the second pressure control valve is closed.

2. The surge suppressor of claim 1, wherein the boost member is a piston.

3. The surge suppressor of claim 2, wherein the piston has a first effective area and the pressure control member has a second effective area, and wherein the first effective area is larger than the second effective area.

4. The surge suppressor of claim 1, wherein:

the air housing includes a chamber wall at least partially defining the second chamber;

the chamber wall has a first end having a first diameter and a second end having a second diameter; and a piston seal extends about the piston and engages the chamber wall.

5. The surge suppressor of claim 4, wherein:

the second diameter is larger than the first diameter; and the first end is disposed between the second end and the first chamber.

6. The surge suppressor of claim 1, wherein the pressure control member includes a diaphragm, wherein the diaphragm at least partially defines a process fluid chamber on a first side of the diaphragm and at least partially defines an air chamber on a second side of the diaphragm.

7. The surge suppressor of claim 1, wherein:

a shaft extends between the boost member and the pressure control member to connect the boost member and the pressure control member; and the shaft extends through the second chamber, through a wall disposed between and dividing the second chamber and an air chamber at least partially defined by the pressure control member, and through the air chamber.

8. The surge suppressor of claim 7, further comprising:

a check valve fluidly connected to the air chamber, the check valve configured to allow air to vent from the air chamber and to prevent liquid from venting from the air chamber.

9. The surge suppressor of claim 1, wherein:

the air housing includes an upper housing and a lower housing, the upper housing at least partially defining the first chamber;

the second chamber is at least partially defined by the boost member and the lower housing;

the first pressure control valve is mounted in the upper housing; and the second pressure control valve is mounted in the lower housing.

10. The surge suppressor of claim 9, wherein the second pressure control valve is configured to vent the working fluid to the second chamber, and wherein the second chamber is fluidly connected to atmosphere to vent the working fluid to atmosphere.

11. The surge suppressor of claim 1, further comprising:

a seal disposed around the shaft, wherein the seal prevents fluid from flowing around the shaft between a lower chamber of the air housing and an air chamber at least partially defined by the pressure control member.

12. A fluid system comprising:

a suppressor housing having a fluid inlet, a fluid outlet, and a process fluid chamber;

an air housing mounted to the suppressor housing;

a suppressor mechanism extending between the air housing and the suppressor housing, the suppressor mechanism comprising:

a boost member disposed within the air housing and dividing the air housing into a first chamber and a second chamber, wherein the boost member is a piston;

a pressure control member secured between the air housing and the suppressor housing, the pressure control member fluidly separating an air chamber and the process fluid chamber;

wherein the boost member and the pressure control member are connected in order to move together;

wherein a first wall is disposed between the air chamber and the second chamber;

wherein a chamber wall of the air housing at least partially defines the second chamber, the chamber wall having a first end having a first diameter and a second end having a second diameter;

wherein the boost member engages the chamber wall such that an effective area of the boost member varies as the boost member shifts within the air housing relative to the chamber wall between the first end and the second end;

a first pressure control valve mounted to the air housing and at least partially extending into the first chamber;

a second pressure control valve mounted to the air housing and at least partially extending into the second chamber;

a working fluid source connected to the air housing and configured to provide working fluid to the first chamber in the air housing to pressurize the first chamber;

wherein the working fluid is configured to bias the pressure control member towards the process fluid chamber by the boost member wherein the first pressure control valve is actuatable between an open state, in which a first fluid path through the first pressure control valve is opened such that the working fluid source and the first chamber are fluidly connected by the first fluid path, and a closed state, in which the first fluid path is closed to fluidly isolate the first chamber from the working fluid source; and wherein the second pressure control valve is actuatable between an open state, in which a second fluid path through the second pressure control valve is opened such that the first chamber and the second chamber are fluidly connected through the second fluid path, and a closed state, in which the second fluid path is closed to fluidly isolate the second chamber from the first chamber.

13. The fluid system of claim 12, wherein the pressure control member includes a diaphragm.

14. The fluid system of claim 12, wherein the boost member has a first effective area and the pressure control member has a second effective area, and wherein the first effective area is larger than the second effective area.

15. A method comprising:

contacting a first pressure control valve with a first side of a boost member of a surge suppressor, thereby shifting the first pressure control valve to a first open state, the first pressure control valve is supported by an upper housing of the surge suppressor;

flowing working fluid into an upper chamber of an air housing through a first valve housing of the first pressure control valve with the first pressure control valve in the first open state, the working fluid increasing a charge pressure in the upper chamber, the upper chamber is at least partially defined by the upper housing;

shifting the boost member, by the working fluid, away from the first pressure control valve and towards a second pressure control valve supported by a lower housing of the surge suppressor that is connected to the upper housing, wherein an effective area of the boost member changes as the boost member shifts towards the second pressure control valve, and wherein the first pressure control valve shifts to a closed state to stop flow of the working fluid into the upper chamber when the boost member disengages from the first pressure control valve;

contacting the second pressure control valve with a second side of the boost member, thereby shifting the second pressure control valve to a second open state;

flowing working fluid out of the upper chamber through a second valve housing of the second pressure control valve and through the lower housing with the second pressure control valve in the second open state, thereby decreasing the charge pressure in the upper chamber;

wherein the boost member is connected to a pressure control member of the surge suppressor to bias the pressure control member into a fluid chamber through which process fluid flows and that is at least partially defined by the pressure control member, the pressure control member configured to dampen vibrations in the process fluid.

16. The method of claim 15, wherein flowing the working fluid into the upper chamber includes pressurizing air with an air compressor and flowing the compressed air to the upper chamber through the first pressure control valve, wherein the compressed air is the working fluid.

17. The method of claim 15, wherein contacting the first pressure control valve with the first side of the boost member includes:

contacting a stem of a poppet valve forming the first pressure control valve with a top side of a piston forming the boost member; and pushing the stem upwards with the top side to shift the first pressure control valve to the first open state.

* * * * *